United States Patent [19]

Reichelt et al.

[11] Patent Number: 4,703,789

[45] Date of Patent: Nov. 3, 1987

[54] CONTROLLING MOLD OSCILLATIONS

[75] Inventors: Wolfgang Reichelt, Moers; Peter Voss-Spilker, Kempen; Ewald Feuerstacke, Dorsten; Klaus Schwarz, Neikirchen-Vluyn, all of Fed. Rep. of Germany

[73] Assignee: Mannesmann AG, Duesseldorf, Fed. Rep. of Germany

[21] Appl. No.: 939,561

[22] Filed: Dec. 8, 1986

[30] Foreign Application Priority Data

Dec. 9, 1985 [DE] Fed. Rep. of Germany ..... 3543790

[51] Int. Cl.[4] ..... B22D 11/16

[52] U.S. Cl. ..... 164/154; 164/416; 164/452

[58] Field of Search ..... 164/150, 154, 416, 452, 164/478, 451

[56] References Cited

U.S. PATENT DOCUMENTS 4,532,975 8/1985 Ives ..... 164/154

FOREIGN PATENT DOCUMENTS 60-21172 2/1985 Japan ..... 164/478

2068803 8/1981 United Kingdom ..... 164/452

*Primary Examiner*—Nicholas P. Godici

*Assistant Examiner*—Richard K. Seidel

*Attorney, Agent, or Firm*—Ralf H. Siegemund

[57] ABSTRACT

Apparatus for controlling the oscillations of a mold for continuous casting of metal, the mold being mounted on a table which is connected, in turn, to three spaced apart drives and three load relief springs; three displacement path transducers track each of the drives; a source of reference signals provides reference signals representing the desired oscillation, as to contour, amplitude and rate; actual and reference signals are compared by and in stages which provide correction signals for the drives.

5 Claims, 3 Drawing Figures

Fig 1a

CONTROLLING MOLD OSCILLATIONS

BACKGROUND OF THE INVENTION

The present invention relates to the control of oscillations of a mold for continuous casting of metal, particularly steel, under utilization of a plurality of drive elements, wherein the moving cycle is at least in parts carried out under utilization of the weight of the mold itself, with inversion being carried out by drive elements.

Molds for continuous casting are required to vibrate and oscillate in many instances, in order to avoid that the casting sticks to the mold walls. This oscillation is for example produced on molds for continuous casting by means of eccentric shafts. An example of this type is disclosed, for example, in German printed patent application No. 34 03 598. The German printed patent applicatio No. 12 73 138 suggests a device for moving a mold in the direction of casting by means of one or several cylinder piston type drives, wherein the mold is carried by an annular piston, denoted in this reference by reference numeral 2, and which cooperates with a correspondingly annular or ring-shaped cylinder identified in that reference by numeral 3. This oscillating or vibrating device is disclosed in that particular publication is disadvantaged by the fact that the mold cannot be guided exactly because it bears upon a ring-shaped cylinder. Even minor shifts from the center of gravity or unbalanced acting resistances will interfer with the desired direction of motion. Also, a disadvantage is the utilization of limit switches for the control of valves, which are exclusively operated in the final positions of the respective device during the oscillation.

The German printed patent application No. 17 83 132 discloses a method and equipment for the control of a drive in an oscillating mold whereby the speed of this drive is linked to a straightening device and its drive, so as to obtain matched conditions of casting. German printed patent application No. 19 57 232 discloses a device and method for oscillating molds for continuous casting, using generally hydraulic cylinder drives.

DESCRIPTION OF THE INVENTION

It is an object of the present invention to provide a new and improved device for the control of the oscillation of a mold for continuous casting of metals, such as steel, under utilization of a plurality of drive elements which produce, at least a primary force, for obtaining the oscillation, whereby specifically the invention is directed towards avoiding skewing of the mold during the operation, and particularly any oblique misorientation vis-a-vis the casting itself.

In accordance with the preferred embodiment of the present invention, it is suggested to provide along the path of each of the drive elements a pick-up transducer which responds to and tracks the displacement path of that particular drive element and provides signals accordingly which are to be compared with predetermined reference values that represent the desired oscillatory motion and commensurate displacement of the mold in that particular area acted upon by the respective drive element, and any deviation is used to control the drive element towards correction.

The drive elements are preferably hydraulic cylinder/piston drives which are controlled through servo valves and which, in turn, are controlled by the output of the aforementioned comparison device. Alternatively, the drives can be electrical linear drives and they are then controlled by the comparing circuit as mentioned and through amplifiers and switches. In either case, a particular table may be provided upon which is imparted the locally requisite displacement, which, on one hand, provide the composite mold displacement while, on the other hand, the table is guided for movement parallel to the axis of the mold. A hydrostatic wedge bearing may be provided.

The drive elements should be connected to a source of energy for providing a force which is considerably larger than the maximum possible friction forces as they may be encountered between the continuously casting strand or ingot and the mold, plus any frictional forces which the table may provide. The oscillating table should be mounted on springs, whereby preferably oil springs are used which are hydraulically operated (adjusted). The springs should have different constants, as will be explained more fully below, particularly in the case of a curved casting.

It can thus be seen that each of the preferably three drive elements for the mold, is associated with a transducer, which at any given time provides an indication of the exact position of the mold and of the drive element and the lifting table. Under the assumption that the position of the table is also known, one can, in fact, track any point of the mold in a very exact fashion. The actual disposition of the table and, therefore, of the mold, is fed to a comparing circuit which compares the position value thus received with variable reference values, which track the desired oscillatory pattern, and the result of that comparison is used as a control signal for affecting the drive elements.

In the case of a hydraulic drive, one must distinguish between a power part and a control part, whereby both of them are connected to a source of pressure, such as oil. The control part includes one or several servo valves as they do control the flow of hydraulic fluid to and from the hydraulic cylinder being the power part. The servo valves themselves are controlled by the comparing circuit. In the case of an electrical linear drive, it is the power current that is fed to that drive which has to be controlled, and an electronic circuit is provided for that purpose responding also and, in fact, including the aforementioned comparing circuit.

The mold support table is positioned rather accurately transversely to the direction of casting. For this certain control arms are provided. Ball bearing could be used for guiding the table in the oscillating directions particularly in case the lifting strokes are small. This guiding may be combined with the drive elemtns, as mentioned above. In the case of a hydraulic cylinder piston drive, as stated, a hydrostatic wedge bearing is useable. The shifting transversely to the direction of casting is quite minimal and remains within the limits of elastic deformation of the mechanical elements involved.

DESCRIPTION OF THE DRAWINGS

While the specification concludes with claims particularly pointing out and distinctly claiming the subject matter which is regarded as the invention, it is believed that the invention, the objects and features of the invention, and further objects, features, and advantages thereof will be better understood from the following description taken in connection with the accompanying drawings in which:

FIG. 1*a* shows two possible modifications for the device shown in FIG. 1; and

Proceeding now to the detailed description of the drawings, FIG. 1 illustrates a mold support table 12 with a mold 11 mounted thereon from which emerges a casting in down direction 10. This table is supported (a) by drive elements 20 and (b) by springs 60. Both kinds of elements, in turn, bear against a base or foundation 10. Only one drive and one spring is shown in FIG. 1 in direct association with the table, other drive elements are represented by the one in the lower left of FIG. 1; in fact there are three each and they are arranged in a pattern as shown in FIG. 2; one can see the symmetry involved. The drive elements 20 could, in the alternative, be arranged in relation to the table 12 such that the table is suspended from a part or frame foundation 13 while springs 60 still support the table from below. This modification is shown in FIG. 1*a*.

Figure 1:
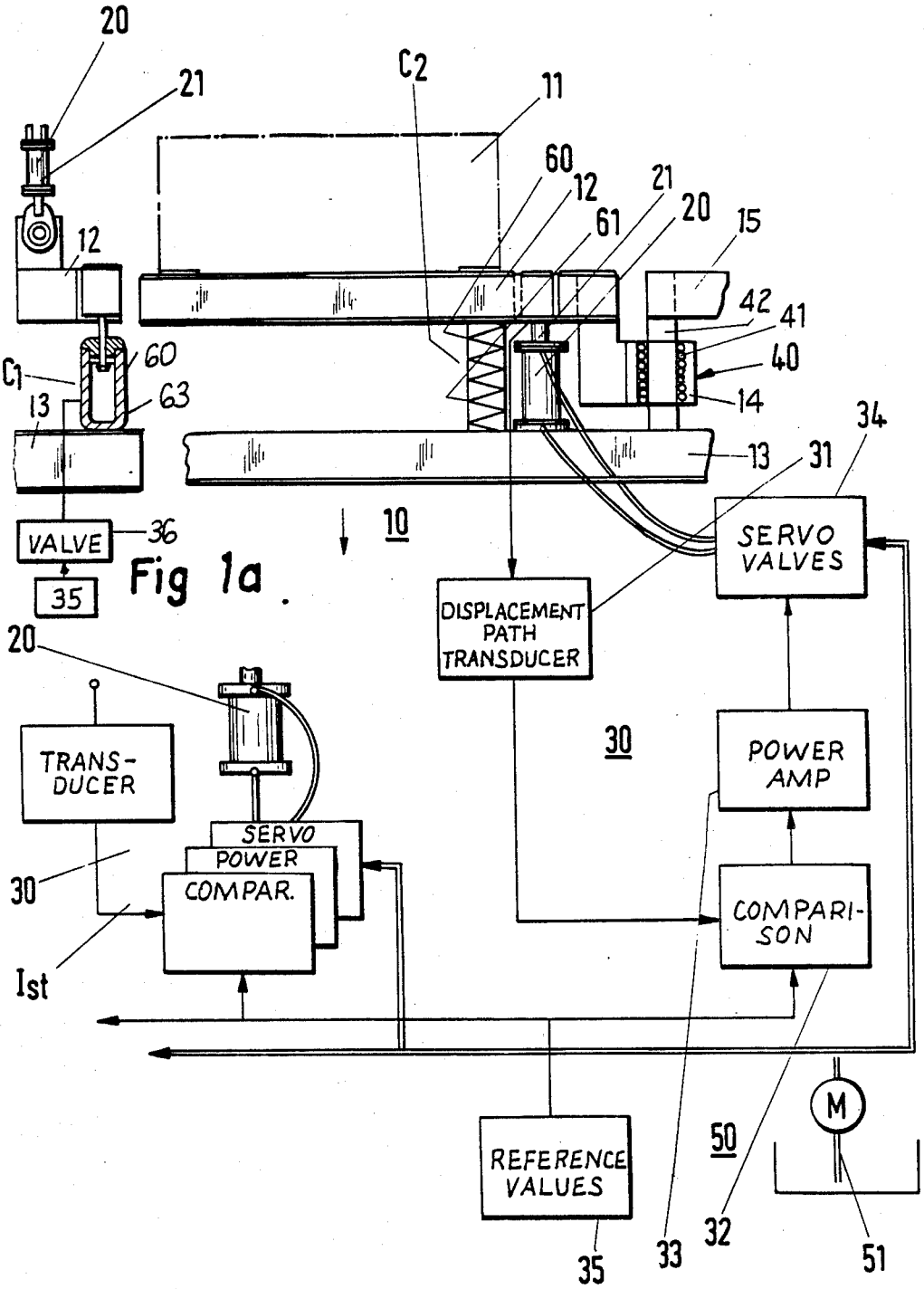
FIG. 1 is partially a schematic side view and partially a block diagram of a mold oscillation control device in accordance with the preferred embodiment of the present invention for practicing the best mode thereof.

The drive elements 20 are assumed to be hydraulic drives, i.e. piston cylinder drives with piston 21. Alternatively, one could use electrical linear drives. The symbolic representation in the drawing could actually be interpreted in either way. The table 12 is vertically guided by in a guide structure 40 such that its horizontal (lateral) movement is restricted. For this then, ball bearings 41 are interposed between a sleeve like extension 14 of table 12 and a post 42 that extends from a frame part 15. Other guide structures can be provided such as linking arms, pivot structures, or the like, to be arranged between the foundation 13, on one hand, and the table 12, on the other hand. In the specific case of a hydraulic cylinder drive 20, as illustrated, a wedge gap type of bearing could be provided for each of the hydraulic drive elements.

As stated, the table 12 rests also on springs 60. One can use either spiral springs 61 or oil hydraulic springs 63 as shown in FIG. 1*a*. It should be noted that the kind of springs used does not depend on what kind of support is provided for the table as far as the drives are concerned; support from below (FIG. 1) or suspension (FIG. 1*a*) or any combination is feasible. Still alternatively, disk springs can be used. These springs support the table 12 on the foundation 13 and are, thus, basically subject to compression. Alternatively, the table could be suspended from the foundation by means of these springs then being acted upon by tension.

Control and measuring elements are associated with each of the drives 20. They include displacement path transducers 31 which, in fact, track the physical displacement of the respective displaceable part (piston rod) 21 of the respective drive. These transducers 31 pertain to a control circuit 30 and are electrically connected to a comparing circuit 32; there is one such control circuit per drive. This comparing circuit 32 receives in addition signals from a source 35 which provides desired and reference value signals. This source 35 ultimately determines the amplitude, the frequency, and the contour of the table displacement. The source 35 could be connected to several control and regulating elements within the group 30. The comparing circuit 32 compares actual values with reference values, and provides corrective signals to a power stage (amplifier) 33. Specifically, these actual values are actually path track increments monitored and tracked by the displacement path transducer. The increments as acquired are, for example, counted and the count values are compared with count values from the reference source which, e.g. digitally, and through up and down counting and positive and negative count values represent the oscillations in terms of contour, rate, and amplitude. The rate of these increments and/or the amplitude may be separately acquired or derived and separate reference signals may be furnished, respectively, as speed and amplitude signals. The latter particularly signal the reversal. When the reference value reaches a maximum, down counting occurs thereafter, and a switch over may be used separately for reversing the hydraulic drives.

As stated, the output of that comparing circuit 32 controls the power component 33, which provides electrical signals at a higher level, and in the case of hydraulic cylinder drives actually controls a servo valve system 34. The valves 34 receive hydraulic power and energy from a source 30, such as a hydraulic fluid source with pump 51.

The control, therefor, is such that the comparing circuits 32 count increments and if a maximum count result is obtained a signal calls for reversal of the hydraulic drives by the valves. The speed of displacement may be controlled separately by way of controlling the degree of valve opening. This obtains by ascertaining the displacement rate and comparing it with speed reference values that may themselves be variable to obtain a particualr contour of the displacement. Thus, the oscillation of the mold as represented by reference signals do not have to be sinusoidal but any oscillatory contour can be generated to be tracked by the control for the mold drives.

Figure 2:
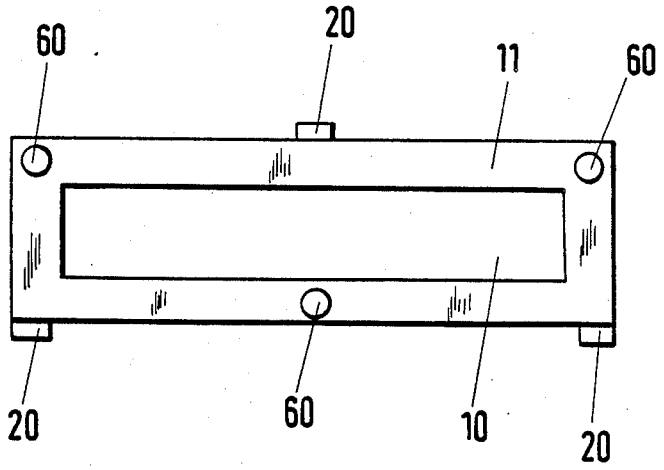
FIG. 2 is somewhat schematically a bottom elevation, showing the mold with various points of force action being identified.

FIG. 2 illustrates the casting 10 in the mold 11. In this particular illustration, the table has been omitted because, in terms of functions, it is basically an intermediary. FIG. 2 also illustrates that the two drive elements 20 at the corners of the long side of the mold 11. The third drive element is in the middle of the opposite long side. The springs 60, as a group are symmetrically arranged to the drives 20. The lower left hand position in FIG. 1 shows symbolically these additional feedback loops for other hydraulic drives each with a separate displacement path transducer comparing circuit, power part and servo valves. However, all comparing circuits operate with a common reference source.

The springs 61 and 63 are provided below the lifting table 10, preferably on that side facing the casting 10. The springs react against the weight of the components on the table 12 and, therefore, reduce the driving force. One will use springs generally with flat characteristics. The spring forces, therefore, act as load relief because they act in a direction opposite to the direction of acceleration and in times also opposite to the direction of the frictional forces. Annular springs or disk springs can be used as stated but even better is the use of so-called oil or hydraulic springs 63 which have the advantage of a high degree of reliability, for example, they can be cooled, they can easily be adjusted, and they are, in fact, subject to very little wear.

The individual springs should be adjusted as to their characteristics wherein particularly the com-pression-/expansion rate of the springs can be used to the following advantage. Of particular interest is the case of an asymmetric weight distribution on the table in a curved withdrawal path for the mold of continuous casting. Those springs that are arranged along the outer curvature or that path should have a rate os expansion/composition which is larger than the springs on the inside of that curve. The upper two springs in FIG. 2 may thus be stiffer thatn the one below. This way, one obtains a better movement of the mold for matching of the curved configuration of the direction of casting. Simultaneously, the individual drive elements should be adjusted so that the desired movement along the radius of casting obtains even when the total lifting stroke of the mold oscillation varies.

The invention device for oscillating a mold for continuous casting, actually operates on every particular point in the feedback loop in a dynamic sense; it is not a passive system or one that augments any natural resilient oscillation of the springs. There is the possibility to vary a variety of parameters in basically an arbitrary fashion, i.e. without essential constraint. Not only is the lifting stroke freely adjustable (amplitude) increment counting and variable during operation but also the frequency of the operation (rate of displacement increments). The active path and displacement measurement within the range of each individual drive element 20, therefore, assures an absolute equal amplitude in the displacement as well as equal phases in all those instances. Since the drive force is to be significantly above any possible friction, it is not to be expected that the oscillating system as such is in a negative sense interferred with. The actual movement as to each particular point on which a force acts is likewise arbitrarily adjustable and selectable.

In dependence upon the molten metal processed by the mold, the oscillation thereof assures a smoother and particularly defect free surface of the casting. Thus, it is possible, for example, to provide for a maximum speed of the mold during the oscillation which in the direction of casting is actually larger than the casting speed in that direction. This way, one obtains a particular smoothing effect on the surface. It should be noted that the available forces in principle, particularly in hydraulic drive systems, are quite high. Therefore, the drive element is disposed outside of the range that could come in one form or another in the reach of molten metal (FIG. 2). The table mentioned above may be supported by the drive elements or may be suspended by them. The drive elements as used have a high degree of reliability, low wear, and have a long use-life.

The invention is not limited to the embodiments described above, but all changes and modifications thereof, not constituting departures from the spirit and scope of the invention are intended to be included.

We claim:

1. Apparatus for controlling the oscillations of a mold for continous casting of metal comprising:

a continuous casting mold;

at least three spaced apart drives connected to said mold;

at least three displacement path transducers for tracking displacements as respectively provided by each of the drives;

a source of reference signals separately providing reference signals representing a desired oscillation, including displacement, amplitude and the oscillation rate;

a plurality of comparing means connected respectively to the transducers and further connected to the source for reference signals, for providing correction signals;

a plurality of power means respectively connected to the drives and to the comparing means for controlling a point of reversal of the drives and their speeds; and load relief springs acting in direction opposing friction between the mold and an emerging casting.

2. Apparatus as in claim 1, said drives being hydraulic drives and said power means being servo values.

3. Apparatus as in claim 1, said mold being mounted on a table, the drives acting on different parts of the table, there being guide means for ensuring movement of the table parallel to the axis of casting.

4. Apparatus as in claim 3, said load relief springs acting on the table in a pattern that is symmetrical with respect to a pattern in which the drives act on the table.

5. Apparatus as in claim 4 wherein said springs have different characteristics so that in the case of curved casting springs on the inside of such curvature are stiffer than on the outside.

* * * * *